US005492399A

United States Patent [19]

Tillack

[11] Patent Number: 5,492,399

[45] Date of Patent: Feb. 20, 1996

[54] SHELF, SHELF SYSTEM OR PARTITION

[76] Inventor: Joachim Tillack, Zeilstrasse 12, D-61467 Kronberg/Taunus, Germany

[21] Appl. No.: 318,890

[22] PCT Filed: Jan. 22, 1994

[86] PCT No.: PCT/DE94/00046

§ 371 Date: Oct. 24, 1994

§ 102(e) Date: Oct. 24, 1994

[87] PCT Pub. No.: WO94/19989

PCT Pub. Date: Sep. 15, 1994

[30] Foreign Application Priority Data

Feb. 23, 1993 [DE] Germany ..... 9302558 U

[51] Int. Cl.[6] ..... F16B 12/10

[52] U.S. Cl. ..... 312/111; 108/91; 211/194

[58] Field of Search ..... 312/111, 107, 312/351.3, 265.2, 265.3, 265.4; 108/180, 193, 153, 60, 91; 211/194, 189; 206/509, 511; 220/4.27, 4.26; 403/294, 292, 306, 298

[56] References Cited

U.S. PATENT DOCUMENTS

| | | | |
|---|---|---|---|
| 2,582,553 | 1/1952 | McMurtrie | 312/111 X |
| 3,103,374 | 9/1963 | Portnoy | 312/351.3 X |
| 3,433,547 | 3/1969 | Hoaglund | 312/111 |
| 3,529,878 | 9/1970 | Blowers | 312/111 X |
| 3,752,511 | 8/1973 | Racy | 403/292 X |
| 3,767,233 | 10/1973 | Hodge | 403/292 X |
| 3,814,033 | 6/1974 | Rudat et al. | 312/107 X |
| 4,322,118 | 3/1982 | Shugart | 312/111 |
| 4,433,881 | 2/1984 | Witten et al. | 312/111 X |
| 4,660,901 | 4/1987 | Shimada | 312/111 |
| 4,681,477 | 7/1987 | Fischer | 403/294 X |
| 4,836,393 | 6/1989 | Maye | 108/91 X |
| 4,852,749 | 8/1989 | Fernandez et al. | 211/294 X |

FOREIGN PATENT DOCUMENTS 2239239 8/1973 Germany .

*Primary Examiner*—Peter M. Cuomo
*Assistant Examiner*—Rodney B. White
*Attorney, Agent, or Firm*—Sixbey, Friedman, Leedom & Ferguson; David S. Safran

[57] ABSTRACT

A shelf, shelf system or partition is to be configured so that a rigid connection of the individual module units is guaranteed when they are stacked atop one another and when assembled next to one another. This is achieved in that U-shaped module units (1) have blind holes (7) that are placed at least approximately centrally to narrow sides (6) of carrying uprights (5). Module units (1) placed atop one another can be connected to one another by connecting elements (12) that can be inserted in blind holes (7) (FIG. 1 ).

24 Claims, 2 Drawing Sheets

SHELF, SHELF SYSTEM OR PARTITION

BACKGROUND OF THE INVENTION

1. Field of the Invention

This invention relates to a shelf, shelf system or partition according to the introductory clause of claim 1.

2. Description of Related Art

In such a shelf system known from DE-A-22 39 239, the U-shaped module units have, at the narrow sides that end exposed, two notches each in the shape of a segment of a circle whose height is less than the radius of the associated circle. In each case, a connecting element in the form of a pin with a central recess whose radius corresponds to that of the notches and whose width is matched to the wall thickness of the module units can be inserted into the notches. By putting two module units atop one another so that their narrow sides that end exposed are opposite one another, the corresponding notches of both module units form a segment of a circle the size of the recess parts of the connecting elements. Both module units are thus kept at a short distance from one another and are fixed in position laterally forward and rearward.

With this known system, out of each two module units with adjacent narrow sides, shelves can be made by placing such two-piece units with their base parts atop one another or with their side walls next to one another. A connection of two-piece units put atop or next to one another is not anticipated. Larger, in particular high shelf walls of this design are thus unstable and additional measures must be taken to prevent the shelf from wobbling, swaying or even collapsing under greater loads.

With this invention the object to be achieved is that a shelf, shelf system or a partition of the type mentioned is to be configured so that a rigid connection of the individual module units is guaranteed when stacked on one another and with assembly next to one another. The shelf, shelf system or partition is also to have great stability even under greater loads. Further, the shelf, shelf system or partition is also to be able to be produced if possible of commercially available, in particular environmentally friendly, material.

This object is achieved by the features of claim 1.

Because of the special configuration and arrangement of the blind holes and the connecting elements provided, an efficient, precise and nonslip assembly is guaranteed without additional aids and simultaneously numerous shelf arrangements are made possible since the module units can be used in different positions.

The assembly of the shelf, shelf system or partition can further be performed quickly without special knowledge. Despite this, great stability and thus also a great load-bearing capacity are made possible for such a shelf, shelf system or partition.

It is true that it is known from DE-A 26 07 210, to produce prefabricated furniture of box-type design, to provide all four surfaces of square panels of laminated wood with several blind holes offset relative to one another and to chamfer the end faces on both edges by 45°. Pegs bent at an angle are used there as connecting elements. To make a stable shelf or a stable cabinet wall, numerous connecting elements are necessary, since with one connecting element only one anchoring in one direction is possible in each case, while an anchoring in two directions is always required.

BRIEF DESCRIPTION OF THE DRAWINGS

Other advantageous details of the invention are indicated in the subclaims and will be described in more detail below based on the embodiments illustrated in the drawing.

There are shown in.

DETAILED DESCRIPTION OF THE PREFERRED EMBODIMENTS

Figure 1:
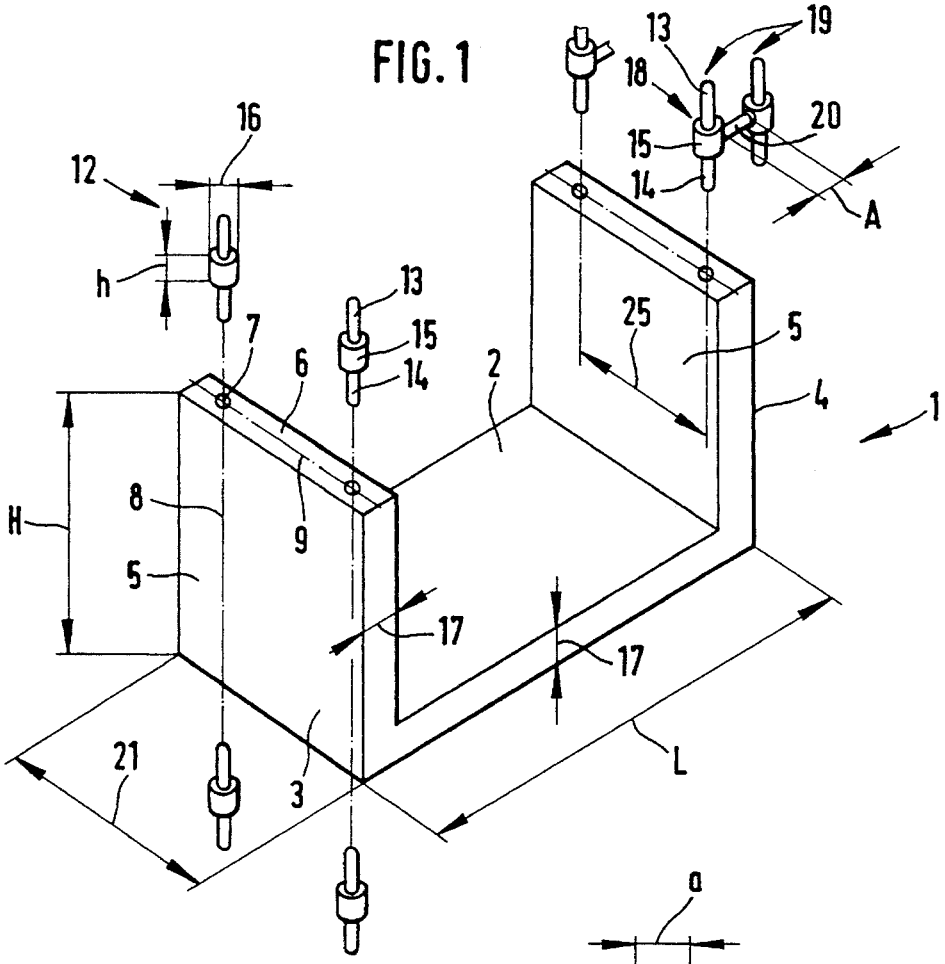
FIG. 1, a perspective view of a U-shaped module unit with connecting elements in an exploded representation, FIG. 2, a front view of module sections in the area of their respective connections, FIG. 3, the perspective view of a carrying panel and FIG. 4, a view of a shelf with module units that can be used in various ways.

In FIG. 1, 1 represents a module unit in a U-shape. It consists of a base panel 2 with carrying uprights 5 provided on lateral ends 3 or 4, perpendicular to base panel 2.

On exposed, narrow side 6 of carrying uprights 5, at least two blind holes 7 are provided whose central axes 8 run perpendicular to base panel 2. They preferably lie on or in the area of center line 9 of narrow side 6 and are placed as far as possible from one another. Optionally, blind holes 7 can be reinforced with a stiffening sleeve 10 to increase stability, as can be seen in FIG. 2.

Figure 2:
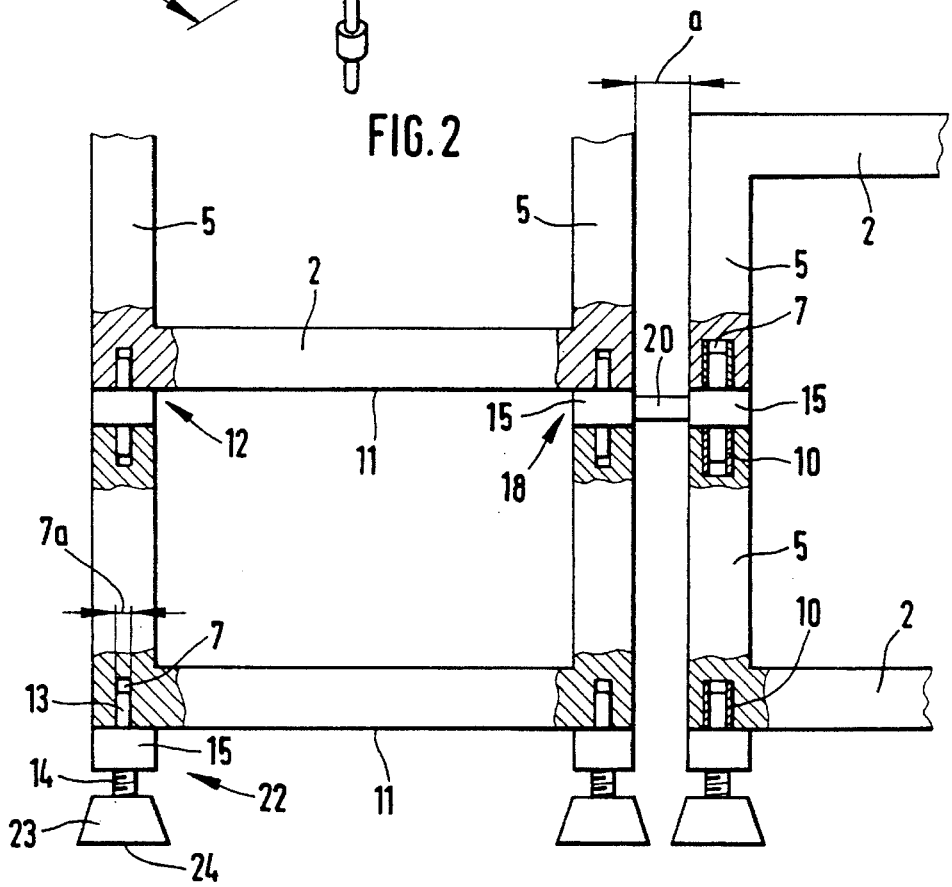
Figure 3:
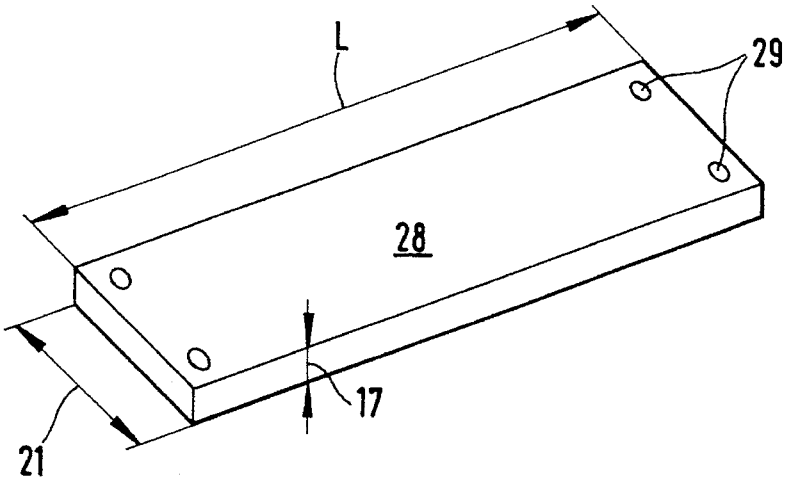

In an extension of central axis 8 of blind holes 7 on narrow sides 6 of carrying uprights 5, analogous blind holes 7 are also placed on opposite side 11, which also forms the outer side of base panel 1, as can be seen more clearly based on the section according to FIG. 2.

Peg-shaped connecting elements 12 are used to connect module units 1 to be placed atop one another. They have an upper and lower peg or pin 13 or 14 and a spacer collar 15 molded on centrally, movably or pushed into the press fit. Pegs or pins 13, 14 can also be inserted, pressed or screwed into correspondingly shaped openings of spacer collar 15.

When spacer collar 15 has a round shape, its outer diameter 16 is at most as large as wall thickness 17 of carrying uprights 5. Spacer collar 15 can also be made as a square or rectangle, and then its width corresponds at most to the thickness of wall 17.

H-shaped connecting elements 18 are provided to connect module units 1 that are to be arranged next to one another. H-posts 19 made of them are made corresponding to peg-shaped connecting elements 12 and thus have a central spacer collar 15 and pegs or pins 13, 14 that project upward or downward. Both spacer collars 15 are rigidly connected to one another, for example by a spacer bar 20 that is molded on, pressed in or screwed in.

The diameter of pegs or pins 13, 14 is matched to that of blind holes 7 so that they can be inserted or driven into the latter without interruption, if possible without play or in press fit. The assembly and connection of module units placed atop and next to one another can be seen in FIG. 2. Simultaneously it can also be seen there that, atop one U-shaped module unit, another module unit can be attached as an upside-down "U," so that a considerably larger open space is produced.

Base panel 2 and carrying uprights 5 of module units 1 preferably have a uniform depth 21. Height H of carrying uprights 5 and length L of base panels 2 of module units 1 can basically be different. But they are always made of a size such that continuous construction is possible.

Figure 4:
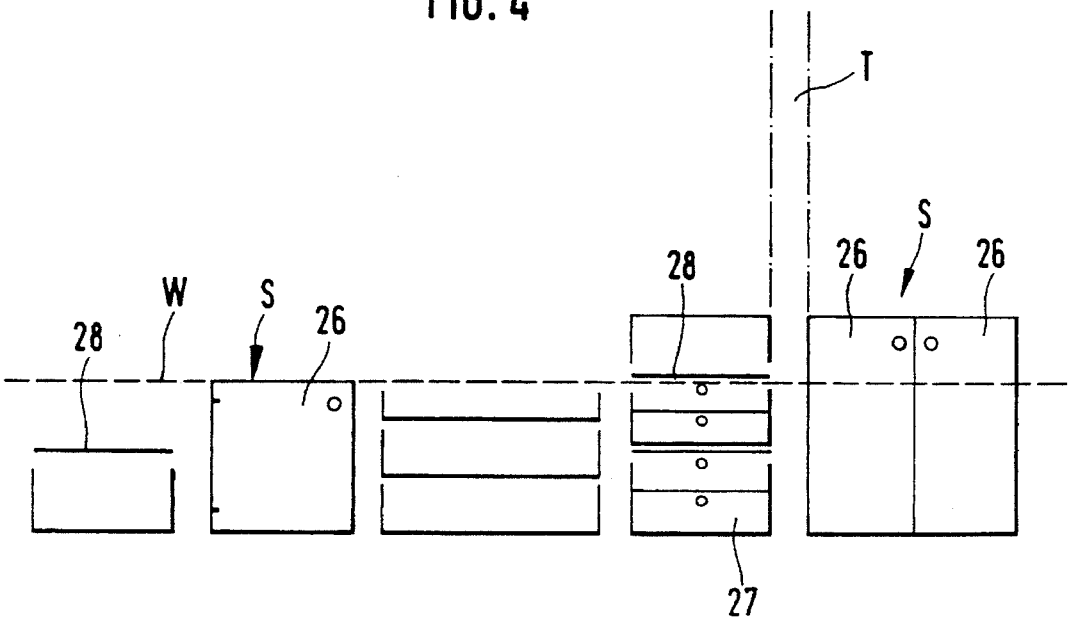

In particular, height H of carrying uprights 5, relative to height h in each case of one spacer collar 15, is of a size such that total heights H+ h of different module units have a ratio to one another such as 1:1.5 or 1:2 or 1:3 or the like. This way, module units 1 of various heights can be placed next to one another, but they always come together after a predetermined height in a common horizontal connecting line W (see FIG. 4), so that units standing next to one another can always be rigidly connected to one another. With a height h of 1.6 cm of spacer collar 15, the height of carrying uprights 5 is, for example, 24 cm, 36.8 cm or 75.2 cm.

Consequently, various lengths L of differently configured module units 1 are selected so that length L of a base panel 2, and length A in each case of one spacer peg 20, i.e., total length L+ A of different module units 1, have a ratio to one another such as 1:1.5 to 1:2. This guarantees that, when different module units 1 are placed in a row, continuous vertical carrying walls T (see FIG. 4) can be formed from carrying uprights 5 located atop one another.

Wall thickness 17 of carrying uprights 5 and of base panels 2 is preferably selected equal. It preferably is about 10 mm to 40 mm, in particular about 20 mm, or a corresponding standard measurement deviating from this.

Diameter 16 or the width of spacer collar 15 is about 70% to 110%, in particular about 90% to 100 %, of wall thickness 17 of carrying uprights 5.

Height h of a spacer collar 15 corresponds about 70% to 120%, in particular about 80% to 90% to wall thickness 17 of carrying uprights 5.

Length A of spacer bars 20 is preferably of a size such that distance a achieved between two carrying uprights 5 of adjacent module units 1 is about 70% to 120%, in particular 80% to 90%, of wall thickness 5. In particular, length A is equal to or approximately equal to height h of spacer collar 15.

Connecting elements 12, 18 of foot elements 22 consist preferably of metal, in particular of aluminum.

As shown in FIG. 2, peg-shaped foot elements 22 can be provided that have a spacer collar 15 and pegs or pins 13, 14. Upper peg or pin 13 can be inserted into a blind hole 7 and lower peg or pin 14 can be inserted into a preferably cup-shaped adjusting foot 23. One or both pegs or pins 13, 14 can have an inner or outer thread into which or onto which adjusting foot 23 can be screwed. Thus an evening of height when assembling the shelf, shelf system or partition can be performed. Suitably, adjusting foot 23 can be expanded downward and outward, in particular conically. Thus a wide base 24 is obtained.

The length of pegs or pins 13, 14 of connecting elements 12 and 18 and of foot elements 22 is about 70% to 200% of wall thickness 17. Blind holes 7 are made correspondingly deep.

Distance 25 between two blind holes 7 is about 90% to 60% of depth 21 of a module unit. At least one additional blind hole 7 can be placed between two blind holes 7 arranged this way, in particular symmetrically to them.

Any high-quality, commercially available, long-lasting and as environmentally friendly as possible a material of great stability can be used as material for the module units. In particular, they consist of solid wood, veneered particle board or plywood. Base panel 2 and carrying uprights 5 are suitably joined by mortise and tenon, for example by wood or metal pins or by suitable grooving of the end faces.

A module unit 1 can also be made as cabinet unit S by hinging, on a carrying upright 5 or on both carrying uprights 5, a door leaf 26 or two door leaves 26. Such a door leaf 26 can also be attached to base panel 2.

Further, one or several module unit(s) 1 can be provided with at least one drawer 27.

Further, a carrying panel 28 can be provided that has the size of a base panel 2 and has, at points allocated to blind holes 7 of the module unit of corresponding size, continuous holes 29 with diameter equal to those of the blind holes of the module units. The thickness of carrying panels 28 corresponds preferably to wall thickness 17 of base panels 2.

Shelves, shelf systems or partitions built according to the invention are inherently stable and thus can be placed free-standing at any point in a room, in particular also be used as partitions. The individual module units can be freely interchanged, and for each such interchange no tools are needed. All connecting elements are made as insertable parts that are easy to produce and easy to use.

We claim

1. Shelf, shelf system or partition consisting of several identical or similar module units connecting elements for connecting said modules to one another, and the module units in each case comprising a U-shaped frame part with base panels which have carrying uprights on each of both end sides and perpendicular to the base panel, said carrying uprights having narrow sides with exposed ends, notches being provided in said narrow sides that correspond to notches of a vertically adjacent module unit and into which the connecting elements are insertable as a means for stacking and connecting module units atop one another in a position, characterized by the following features:

the notches of the narrow sides are each made as a blind hole that extends perpendicular to the base panel;

the blind holes are placed centrally or at least almost centrally with respect to the narrow side of the carrying upright;

on an extension of central axes of said blind holes in the exposed ends of the narrow sides of the carrying uprights, further blind holes are provided in each case on a side of the base panel which is opposite the respective narrow side;

peg-shaped connecting elements which are insertable into the blind holes for connecting module units together one on top of another and that have, in a central area thereof, a spacer collar with an outer diameter or width that is equal to or less than a wall thickness of the carrying uprights;

and wherein posts of the connecting elements have, in the central area, molded-on or pushed-on spacer collars that are connected rigidly to one another by a spacer bar.

2. Shelf, shelf system or partition according to claim 1, wherein H-shaped connecting elements are provided for connecting module units placed next to one another.

3. Shelf, shelf system or partition according to claim 1, wherein module units with different heights of carrying uprights are provided whose heights, relative to height (h) in each case of one spacer collar are in a ratio of from 1:1.5 to 1:3.

4. Shelf, shelf system or partition according to claim 3, wherein module units (1) with different length base panels are provided whose length relative to a length of each spacer bar is in a ratio of from 1:1.5 to 1:2.

5. Shelf, shelf system or partition according to claim 1, wherein base panels (2) and carrying uprights (5) have an approximately equal wall thickness (17).

6. Shelf, shelf system or partition according to claim 5, wherein wall thickness (17) of base panel (2) is about 10 mm to 40 mm, in particular about 20 mm.

7. Shelf, shelf system or partition according to claim 1 wherein diameter (7*a*) of blind holes (7) is about 20% to 80%, in particular about 35% to 60% of wall thickness (17) of base panel (2).

8. Shelf, shelf system or partition according to claim 7, wherein blind holes (7) are each bushed with a stiffening sleeve (10).

9. Shelf, shelf system or partition according to claim 1, wherein height (h) of a spacer collar (15) is about 70% to 120%, in particular about 80% to 90% of wall thickness (17) of base panel (2).

10. Shelf, shelf system or partition according to claim 1, wherein length (A) of a spacer bar (20) is about 70% to 120%, in particular about 80% to 90% of wall thickness (17) of base panel (2).

11. Shelf, shelf system or partition according to claim 1, wherein length (A) of a spacer bar (20) is about equal to height (h) of a spacer collar (15).

12. Shelf, shelf system or partition according to claim 1, wherein at least one of the module units (1) has a door leaf (26) hinged to one or to each one of both carrying uprights (5).

13. Shelf, shelf system or partition according to claim 12, wherein at least one of the module units (1) has at least one drawer (27).

14. Shelf, shelf system or partition according to claim 1, further comprising at least one carrying panel of the size and wall thickness of a base panel and that has, at corresponding points at which blind holes are provided, continuous holes of equal diameter.

15. Shelf, shelf system or partition according to claim 1 wherein connecting elements (12, 18, 22) consist of metal, in particular of aluminum.

16. Shelf, shelf system or partition according to claim. 1, wherein peg-shaped foot elements are provided that each have a collar and a first peg which is insertable into a blind hole and a second peg on which an adjusting foot is provided, said adjusting foot being adjustable in height by a thread on at least one of the pegs.

17. Shelf, shelf system or partition according to claim 16, wherein adjusting foot (23) is widened downward, in particular conically, to a larger base (24).

18. Shelf, shelf system or partition according to claim 16, wherein adjusting foot (23) is made cup-shaped.

19. Shelf, shelf system or partition according to claim 16 wherein the peg lengths of the connecting elements (12, 18) and of foot elements (22) correspond 70% to 200% of the wall thickness (17) of the module units (1).

20. Shelf, shelf system or partition according to claim 1 wherein a distance (25) of two blind holes (7) from one another corresponds about 90% to 60% of depth (21) of a module unit (1).

21. Shelf, shelf system or partition according to claim 20, wherein at least another blind hole (7) is placed between two blind holes (7), in particular symmetrically to the latter.

22. Shelf, shelf system or partition according to claim 21, wherein module units (1) consist of solid wood, veneered particle board or of plywood.

23. Shelf, shelf system or partition according to claim 22, wherein base panel (2) is joined by mortise and tenon to carrying uprights (5).

24. Shelf, shelf system or partition according to claim 1, wherein, with a height (h) of spacer collar (15) of 1.6 cm, height (H) of carrying uprights (5) is 24 cm, 36.8 cm or 75.2 cm.

* * * * *